United States Patent [19]

Kurherr

[11] 4,451,219

[45] May 29, 1984

[54] VALVELESS BI-CHAMBER ROTARY STEAM ENGINE WITH TURBINE EFFECT

[75] Inventor: Waldemar H. Kurherr, Duesseldorf, Fed. Rep. of Germany

[73] Assignee: Kurherr Motoren A.G., Baar, Switzerland

[21] Appl. No.: 536,569

[22] Filed: Sep. 28, 1983

Related U.S. Application Data

[63] Continuation of Ser. No. 216,820, Dec. 15, 1980, abandoned.

[51] Int. Cl.[3] ..... F01C 1/00; F01C 21/00

[52] U.S. Cl. ..... 418/138; 418/264; 418/253

[58] Field of Search ..... 418/138, 253, 254, 235, 418/264, 260

[56] References Cited

U.S. PATENT DOCUMENTS

| | | | |
|---|---|---|---|
| 809,637 | 1/1906 | Spencer | 418/264 |
| 1,492,456 | 4/1924 | Hansen-Ellehammer | 418/260 |
| 2,071,799 | 2/1937 | Mabille | 418/138 |
| 2,153,587 | 4/1939 | Parreira | 418/264 |
| 2,562,698 | 7/1951 | Clerc | 418/264 |
| 3,121,398 | 2/1964 | Baker | 418/264 |
| 3,904,327 | 9/1975 | Edwards | 418/264 |
| 3,976,403 | 8/1976 | Jensen | 418/138 |
| 3,988,083 | 10/1976 | Shimizu | 418/264 |
| 4,241,713 | 12/1980 | Crutchfield | 418/138 |

*Primary Examiner*—Ronald B. Cox

*Attorney, Agent, or Firm*—Cushman, Darby & Cushman

[57] ABSTRACT

The instant invention relates to a valveless bi-chamber rotary steam engine with turbine effect comprising two sets of rotor blades of which each set of rotor blades rotates around its own eccentric point on a stationary mutual crank shaft within a semicircular engine housing. A drum-type rotor is concentrically mounted within the engine housing thus forming two diametrically opposed radial chambers. The said two sets of rotor blades move through equidistant slots arranged within the drum-type rotor thus varying the space volume of the respective radial chamber where through the introduction of a pressurized medium through diametrically arranged inlet ports the generation of a torque moment is achieved.

21 Claims, 2 Drawing Figures

VALVELESS BI-CHAMBER ROTARY STEAM ENGINE WITH TURBINE EFFECT

This is a continuation of application Ser. No. 216,820, filed Dec. 15, 1980 now abandoned.

BACKGROUND OF THE INVENTION

It has long been the dream of technologist's to develop a large rotary machine such as the rotary steam engine.

Unfortunately not enough attention was given to the compensation of internal pressures.

It is therefore the aim of the instant invention to demonstrate a large rotary steam engine with a fully compensated internal pressure.

Since James Watt, large steam engines has to add a lubricant to the steam to lubricate the piston and various sliding seals.

It is therefore a further aim of the instant invention to demonstrate a large steam engine working without the addition of a lubricant to the steam.

Prior art devices show a large number of sliding parts and seals generating a large amount of friction and wear.

It is also the aim of the instant invention to show a large rotary steam engine having no sliding and thus friction and wear generating parts or seals other than sealed bearings.

In prior art turbine machines the following disadvantageous features are observed:

Conventional turbine machines hold the max. rate of efficiency only under full load condition. Under partial load condition the rate of efficiency tends rapid towards zero. Furthermore a constant high rate of revolution is necessary whereby a reduction of the rate of revolution reduces the rate of efficiency rapidly.

Moreover, turbine machines are high temperature machines because they utilize the kinetic energy of fast moving gas molecules only and need therefore preferably temperatures above 300° C. to account for a respectable efficiency.

It is therefore the aim of the instant invention to demonstrate a large low temperature rotary steam engine which utilizes the expanding pressure force of a inherent pressurized medium and which in addition utilizes the kinetic energy of fast moving gas molecules as found in turbine application, wherethrough the holding of the effeciency rate at varying load condition becomes possible.

The rate of revolution of a conventional steam engine is also limited by the main slide valve which generates friction and tends to seizure.

One further aim of the instant invention is to demonstrate a large rotary steam engine without any valves and therefore resulting limitations.

SUMMARY OF THE INVENTION

The objects of the instant invention are attained by constructing a valveless bi-chamber rotary steam engine with turbine effect that functions mainly as an expansion steam engine that additionally also utilizes the turbine effect to contribute to the overall effeciency.

Under turbine effect is understood the utilization of the kinetic energy of fast travelling gas molecules that impinge upon the rotor blades as found in conventional turbine application.

As the rotation increases the amount of kinetic energy/revolution also increases thus boosting the over-all efficiency of the expansion steam engine process of the instant engine.

The instant invention comprises two sets of mobile rotor blades of which each set of rotor blades rotates around it's own eccentric point on a stationary mutual crank shaft within a semicircular engine housing. The semicircular engine housing consists of a upper and a lower half engine housing whereby both halfs are screwed tightly together with their flange rims. Furthermore the upper and the lower half of the engine housing each embody a steam inlet port and a steam outlet port of which the inlet ports and the outlet ports are diametrically arranged to each other. A drum-type rotor is concentrically mounted within the engine housing whereby two diametrically opposed radial chambers are formed. The drum-type rotor is composed of two large rotor-disks which are rotatably concentrically arranged and of which one rotor disk possesses in the center a hub and the other rotor disk a shaft for the power takeoff. Both hub and shaft run on sealed bearings.

Drum plates are fastened equidistand at the inside rim of the rotor-disks leaving a slot between each other.

The slot sides of the drum plates end in a semi-circular inwardly bend seal plate. Between the said seal plates inside the sides of the rotor disks circular-disks are rotatably mounted on bearings. On the surface facing out of the rotor disk four bolts are rigidly sticking out on which rolls are rotatably mounted on bearings. Two sealing bars are mounted on the sides of the circular disks thus connecting them and the rolls together, to one unit.

The outside surface of the sealing bar is formed to follow tightly without contact the inside curvature of the said seal plates.

The inside surface of the sealing bar is formed to fit half the circumference of two rolls without contacting them. Lengthwise on the outside and on the inside surface of each sealing bar thin slots are arranged such that a frictionless labyrinth sealing effect is accomplished. Also lengthwise on the outer surface of the drum plates slots are arranged whereby a further frictionless labyrinth sealing effect is reached. The rotor blades have on the outer narrow surface lengthwise arranged slots whereby a frictionless sealing effect is achieved thus permitting the rotor blades to travel contactless close to the chamber walls.

Sliding friction of the rotor blades is prevented by having the rotor blades roll on the rolls whereby the sides of the rotor blades are preferably teflon coated to enhance sealing.

Due to the fact that no parts experience a sliding or rubbing action (except the sealed bearings) and because all dynamic sealing (except the sealed bearings) is done by labyrinth seals therefore no lubricant need to be added to the steam or other working non-self lubricating medium.

The steam enters the inlet port and impinges upon the rotor blades thereby donating it's kinetic energy thus producing a torque moment upon the rotor blades.

At the beginning of rotation the torque moment delivered by the kinetic energy of the steam is much smaller as the torque moment delivered by the expansive pressure force of the steam. As the revolution increases also the amount of kinetic energy/revolution increases thus adding to the overall efficiency of this machine. The sealing quality of the labyrinth seals increase rapidly with the number of revolutions.

Each set of rotor blades tightly follows the inside curvature of it's respective radial chamber thereby subdividing the radial chamber into at least two sealed from each other space volume varying chamber parts, wherefore a continuous work condition is reached and therefore valves become superfluous.

Through the introduction of a pressurized medium, such as steam through the diametrically opposed inlet ports the pressure on the drum type rotor plate surface comes to bear on the two diametrically opposed rotor plate surface parts whereby a total pressure compensation is attained. Large machines that work with a highly pressurized working medium, such as the rotary steam engine, are technically only feasible when the internal pressure is completely compensated as shown by the instant invention.

It is self evident that the instant invention is ideally suited for low temperature application, especially geothermal application, and should in many cases due to the higher over-all efficiency supplant the conventional turbine in power plants.

Further application are among other the direct utilisation of pressurized air stored in underground cavities for power plant peak houer usage and also the direct usage of pressurized underground gas.

Also highly corrosive medien can be used due to the fact that the instant invention can be made out of high temperature resistant non-corrosive platic.

The labyrinth sealing ability of the drum-type rotor against the upper and the lower engine housing is enhanced due to the fact that some of the partially expanded working medium is carried over from the outlet port side to the inlet port side within the labyrinth slots of the drum plates.

BRIEF DESCRIPTION OF THE DRAWINGS

Other and further objects of the instant invention will become more apparent from the following detailed description of the various embodiments thereof when taken with reference to the appended drawings in which like characters refer to like structure and in which.

DETAILED DESCRIPTION OF A PREFERRED EMBODIMENT

Figure 1:
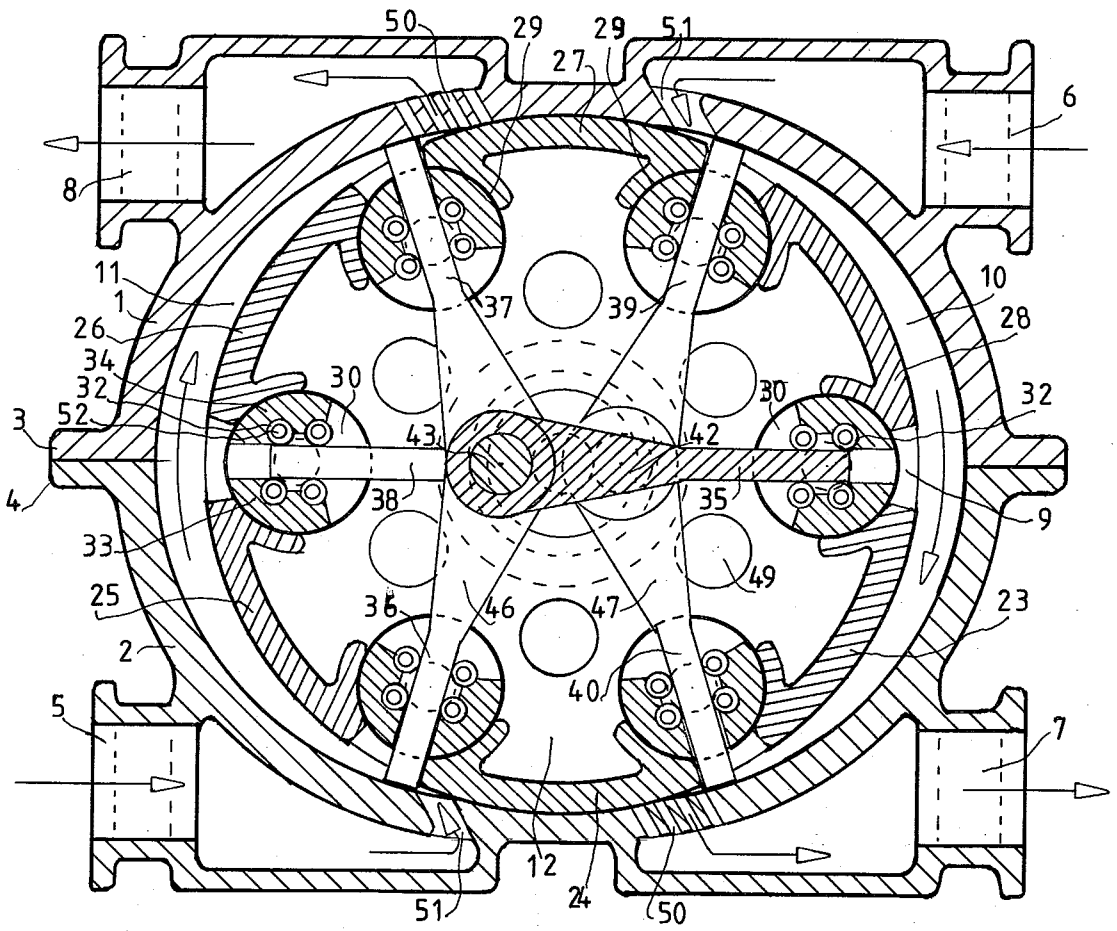
FIG. 1 shows a vertical cut side view of the instant invention.
Figure 2:
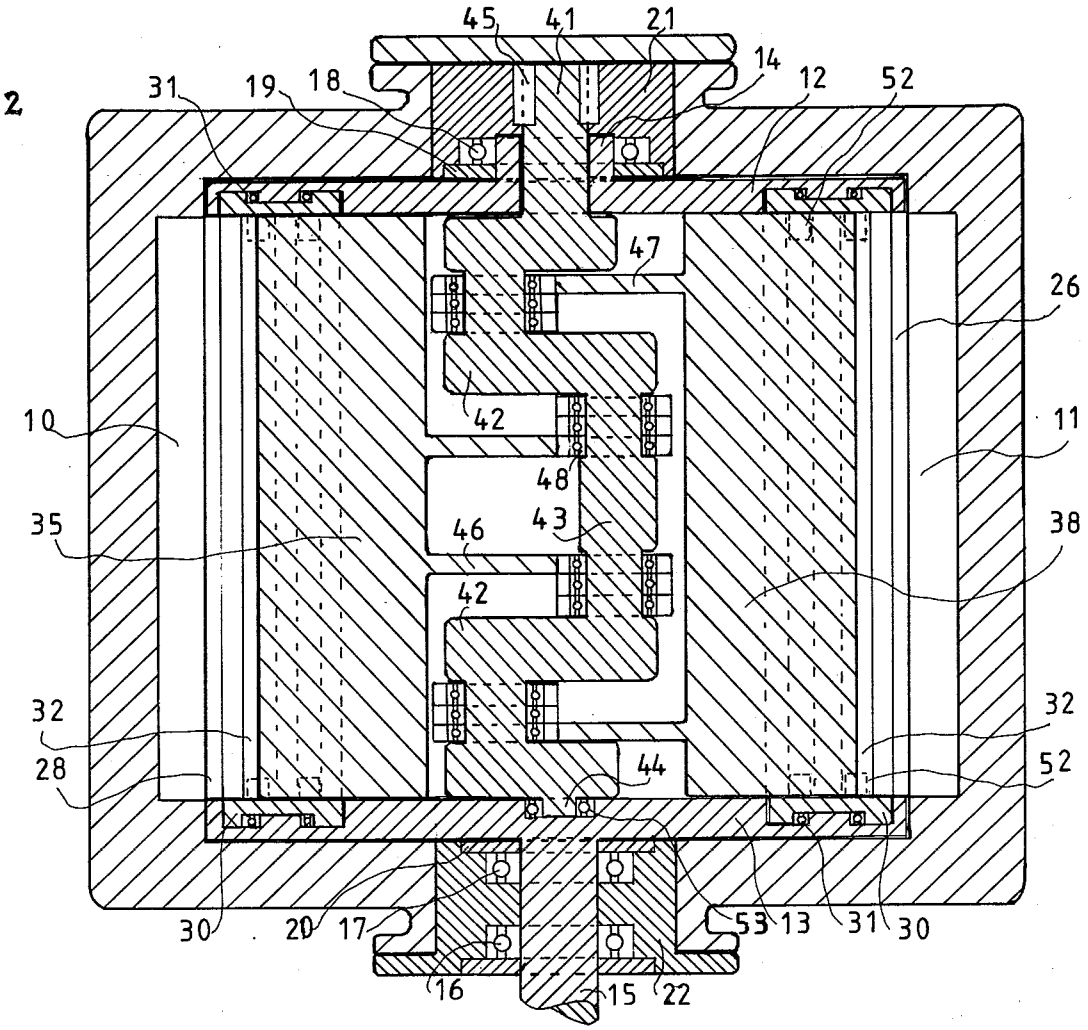
FIG. 2 shows a horizontal cut top view of the instant invention.

The instant invention as illustrated in FIGS. 1 and 2 comprises: A semicircular engine housing consisting of the upper half engine housing 1 and the lower half engine housing 2, whereby both halfs are tightly screwed together with their flange rims 3 and 4. Both the upper engine housing 1 and the lower engine housing 2 embody a steam inlet port 5 and 6 and a steam outlet port 7 and 8 respectively whereby the inlet ports 5 and 6 are situated diametrically and the outlet ports 7 and 8 are also situated diametrically to each other. A drum-type rotor 9 is mounted concentrically within the engine housing 1 and 2, thereby forming the two diametrically opposed radial chambers 10 and 11. The drum-type rotor 9 comprises two rotor disks 12–13 of which rotor disk 12 possesses in the center a hub 14 and rotor disk 13 possesses a center shaft 15 for the power take-off. The shaft 15 runs on bearings 16 and 17. The hub 14 runs on the bearing 18. The ring-shaped disks 19 and 20 embody packing rings and are mounted rigidly inside their respective housing insert 21 and 22.

On the inside between the rotor disks 12 and 13 are the drum plates 23, 24, 25, 26, 27 and 28 rigidly mounted, leaving a slot between each other. The drum plates 23, 24, 25, 26, 27 and 28 each end in two semi-circular inwardly bent seal plates 29.

The six circular disks 30 are rotatable mounted inside the rotor disks 12 and 13 on sealed non-corrosive bearings 31.

On the surface of each circular disk 30 four rigid bolts 52 are sticking out on which rolls 32 are rotatably mounted on sealed non corrosive needle roller bearings. Two sealing bars 33 and 34 are mounted on the sides of each circular disk 30 and screwed rigidly together thus forming with the rolls 32 one unit.

The outside surface of the sealing bars 33 and 34 is formed to follow tightly, without contact the inside curvature of the seal plates 29.

The inside surface of the sealing bars 33 and 34 are formed to fit half the circumference of two rolls 32 without contact. Lengthwise on the outside and on the inside surface of each sealing bar 33 and 34 thin slots are arranged (not shown) such that a frictionless labyrinth sealing effect is obtained.

On the outer surface of the drum plates 23, 24, 25, 26, 27 und 28 are lengthwise also slots arranged (not shown) whereby a frictionless labyrinth sealing effect is attained.

On the outer narrow surface of the rotor blades 35, 36, 37, 38, 39 and 40 are lengthwise narrow slot arranged (not shown) whereby a frictionless labyrinth sealing is achieved thus permitting the rotor blades 35, 36, 37, 38, 39 and 40 to travel contactless close to the walls of the radial chambers 10 and 11.

Sliding friction is prevented by having the rotor blades 35, 36, 37, 38, 39 and 40 roll on rolls 32 whereby the sides of the rotor blades 35, 36, 37, 38, 39 and 40 are preferably teflon coated to enhance sealing.

A stationary crankshaft 41, 42, 43 and 44 comprising the rigidly with wedge pieces 45 secured concentrically situated crankshaft piece 41, further the eccentrically situated crankshaft piece 43 on which the set of rotor blades 35, 36 and 37 are rotatably mounted with their connecting rods 46 and respective sealed non-corrosive bearing 48.

The other eccentrically situated crankshaft piece 42 comprises the set of rotor blades 38, 39 and 40 the connecting rods 47 and the respective sealed non-corrosive bearings 48.

The other centrally situated crankshaft end 44 is rotatable mounted within the rotor disk 13 inside a sealed non-corrosive bearing 53. To ease the assembly openings 49 are made inside the rotor disks 12 and 13.

The outlet ports 7 and 8 have small holes 50 leading out of the respective rotor housing 1 and 2, to reduce sound generation.

The inlet ports 6 and 7 have maximum sized holes 51.

It will be manifestly appreciated by those skilled in the art that the instant invention can be employed in various form. It should be understood therefore that the various embodiments herewith described and disclosed have only been shown by way of example and other and further modifications of the instant invention may be made without avoiding the spirit or scope thereof.

The embodiments of the instant invention in which an exclusive property or privilege is claimed is defined as follows.

I claim:

1. A displacement type rotary system turbine engine comprising:

a housing having means defining a hollow, interior chamber formed from at least three aligned and intersecting partial cylindrical members;

a stationary crankshaft mounted so as to extend across said hollow interior chamber, said crankshaft having a central axis positioned at the center of said interior chamber and two separate outboard, eccentrically positioned axes each spaced an equal predetermined distance from said central axis;

drum means rotatably and concentrically mounted within said hollow interior chamber and about said stationary crankshaft for forming said hollow interior chamber into at least two diametrically opposed radial chambers, at least two sets of a plurality of sealing blades, each set being separately eccentrically and slidably mounted interiorly of said drum means about one of said outboard axes on said stationary crankshaft, each of said sets of blades rotating together with said drum means so that each of said at least two sets respectively rotate through a circular path and effect frictionless labyrinth sealing through only one of said at least two diametrically opposed radial chambers as said drum means rotates with each blade being radially movable therein, said housing further including inlet and outlet means for allowing entry and exit of a working medium to each of said at least two radial chambers, and power take-off means operatively associated with said drum means for connecting said engine to a utility device so that as the working medium enters the inlet means for each chamber, the drum means will be rotated by the effect the working medium has on said sealing blades as said sealing blades pass through their respective radial chambers.

2. A valveless rotary steam turbine engine comprising stationary engine housing having an interior chamber defined by a pair of opposing end walls and a continuous side wall, the side wall of which is defined by the intersection of at least three partial cylindrical members connected together to define a single interior chamber, the central axes of said partial cylindrical members being aligned so as to be parallel and lying in a common plane, with adjacent ones of said central axes being spaced apart by an equal, predetermined distance thereby defining the lines of intersection, a stationary crankshaft rigidly mounted in said interior chamber, a rotatably mounted drum-type rotor revolving concentrically about said crankshaft, at least one pair of diametrically opposed radial chambers defined by the side walls of said interior chamber and the outer surface of said drum-type rotor, said housing including means defining a plurality of diametrically situated inlet ports and outlet ports connecting with said radial chambers, said rotor including at least two separate sets of rotor blades rotatably mounted on corresponding eccentric parts of said crankshaft so that one set rotates about the outermost of said central axes and slidably mounted within said drum-type rotor, each of said sets of said rotor blades extending during at least a portion of each engine cycle into only one of said at least one pair of diametrically opposed radial chambers and wherein thin slots are arranged lengthwise on the outermost surface of said rotor blades and on the exterior surface of said drum plates to form frictionless labyrinth sealing with respect to the interior surfaces of said engine housing.

3. An engine as in claim 1, wherein said inlet means includes at least one inlet port for each of said radial chambers to direct the pressurized working medium into said radial chambers at an angle with respect to said sealing blades, thereby increasing engine efficiency.

4. An engine as in claim 1, wherein said drum means includes means for sealing each of said blades as it moves radially with respect to said drum means.

5. An engine as in claim 4, wherein said sealing means comprises a plurality of sealing rollers.

6. An engine as in claim 5, wherein said sealing rollers are teflon coated.

7. An engine as in claim 1, wherein said sealing blades have teflon coated sides.

8. An engine as in claim 1, wherein said housing, said drum means and said sets of sealing blades are made from high temperature resistant, non-corrosive plastic.

9. An engine as in claim 1, wherein each of said sets of sealing blades are mounted to a fixed camshaft centrally positioned within said interior chamber with each of sealing blades positioned equidistantly about the circumference of said drum means.

10. An engine as in claim 9, wherein said drum means includes two opposing end members each of which is rotatably mounted about said fixed camshaft.

11. An engine as in claim 9, wherein said drum means further includes a plurality of separate sections secured so as to define a plurality of axially extending slots through which said sealing blades reciprocate and blade sealing means movably mounted within said slots for sealing each of said sealing blades within said slots as they move therethrough.

12. An engine as in claim 11, wherein said sealing means provide a rolling seal.

13. An engine as in claim 11, wherein said sealing means includes a pair of mounting members rotatably secured within said two opposing end members so as to be diametrically opposed to one another, first and second sealing bars mounted between said pair of mounting members so as to lie on opposite sides of and spaced from said sealing blades and at least one sealing roller rotatably mounted within each of said first and second sealing bars so as to engage said sealing blade.

14. An engine as in claim 13, wherein means defining labyrinth seals are provided between said rollers and said sealing bars and between said sealing bars and said slots.

15. An engine as in claim 1, wherein said inlet and outlet means include means defining an opening into said housing and a valveless passage extending from said opening directly to said radial chamber.

16. An engine as in claim 1, wherein thin slots are arranged lengthwise on the outermost surface of said sealing blade to effect the frictionless labyrinth sealing.

17. An engine as in claim 1, wherein said drum means includes means defining a plurality of pairs of diametrically opposed slots through which said blades slide and wherein the blades corresponding with each pair of diametrically opposed elongated slots are of different sets of blades.

18. An engine as in claim 1, wherein said drum means includes a plurality of drum plates that together define the exterior surface thereof and wherein a plurality of labyrinth slots extend about the exterior surface of said drum plates in a direction parallel to the axis of said drum means, said labyrinth slots serving to carry some of the partially expanded working medium over from the outlet port side to the inlet port side.

19. An engine as in claim 1, wherein the respective member of said radial chambers are arranged in diametrically opposed pairs and said sets of sealing blades comprise an uneven number of blades arranged so that each diametric alignment of sealing blades is comprised of two sealing blades belonging to a separate set.

20. An engine as in claim 2, wherein said rotor further includes two rotor disks, one having a central hub and theother having a central shaft for power output, said drum-type rotor further including a plurality of longitudinally extending drum plates rigidly interconnecting said rotor disks and evenly spaced apart about the circumference of said rotor thereby defining openings through which said rotor blades move, sealing means rotatably mounted to said rotor to seal the movement of said blades within said openings.

21. An engine as in claim 20, wherein said sealing means comprises a plurality of circular disks rotatably mounted on each of said two rotor disks, a pair of spaced apart slidable sealing plates rotatably mounted within said opening between said rotor drum plates on opposite sides of and spaced from the rotor blade passing therethrough and a plurality of rotatably mounted sealing bars extending axially along said openings for rotatably engaging and for sealing between both said sealing plates and said rotor blades.

* * * * *